US005094083A

United States Patent [19]

Horn et al.

[11] Patent Number: 5,094,083

[45] Date of Patent: Mar. 10, 1992

[54] STIRLING CYCLE AIR CONDITIONING SYSTEM

[76] Inventors: Stuart B. Horn, 3805 Acosta Rd., Fairfax, Va. 22031; Buford T. Walters, 3589 N. Forestdale Ave., Woodbridge, Va. 22193

[21] Appl. No.: 566,765

[22] Filed: Aug. 14, 1990

[51] Int. Cl.[5] ..... F25B 9/00

[52] U.S. Cl. ..... 62/6; 62/434; 62/239; 62/228.5; 62/160; 60/517; 60/525

[58] Field of Search ..... 62/6, 434, 239, 228.5, 62/160; 60/517, 518, 525

[56] References Cited

U.S. PATENT DOCUMENTS

| | | | |
|---|---|---|---|
| 4,123,916 | 11/1978 | Kreger | 62/6 X |
| 4,180,984 | 1/1980 | Chellis | 62/6 |
| 4,253,303 | 3/1981 | Liljequist | 60/517 |
| 4,312,188 | 1/1982 | Swenson et al. | 62/160 |
| 4,330,992 | 5/1982 | Senft | 60/518 |
| 4,748,823 | 6/1988 | Asano et al. | 62/239 |
| 4,796,438 | 1/1989 | Sato | 62/228.5 X |
| 4,843,826 | 7/1989 | Malaker | 62/6 |
| 4,996,841 | 3/1991 | Meijer et al. | 62/6 X |

*Primary Examiner*—Henry A. Bennet
*Assistant Examiner*—Christopher B. Kilner

[57] ABSTRACT

An environmentally safe cooling system employing a non-freon base Stirling cycle cooler whereby a coolant is cooled in a heat exchanger, circulated to a remote location to a set of refrigeration coils (over which air is circulated) and subsequently recirculated to the heat exchanger for removal of the coolant absorbed heat to repeat the cycle.

3 Claims, 2 Drawing Sheets

STIRLING CYCLE AIR CONDITIONING SYSTEM

BACKGROUND OF THE INVENTION

Field of the Invention

This invention relates to air conditioners and more particularly to environmentally safe air conditioners and cooling systems.

A global warming trend has been observed over the last decade with clear indications that one of the major contributing causes is a gradual dissipation of the ozone layer surrounding the earth. A number of factors have contributed to this phenomenon but all indications are that freon is one of the major culprits in effecting this change, with air conditioning systems being the primary source of released freons into the atmosphere.

In addition to the freon based coolant gases used in today's cooling systems, the present systems also uses numerous components, such as compressors, heat exchangers, expansion valves, dryers, high pressure lines, etc. which are prone to require extensive maintenance, are somewhat heavy and bulky and consume considerable space.

The instant invention overcomes all the disadvantages of the prior art systems by using an environmentally safe gas and by eliminating the bulky and heavy compressor, dryer and high pressure lines, as well as the troublesome expansion valve.

This invention is readily adaptable to automotive, home and commercial air conditioning systems to include refrigerated boxcars and trailers, and with some modification to freezer applications as well.

SUMMARY OF THE INVENTION

This invention uses a Stirling cycle cooler which offers the advantage of Carnot efficiency, in the ideal case, small size and weight and low fabrication cost.

This system utilizes such a cooler to lower the temperature at some designated point, normally referred to as a "cold finger", at which point a heat exchanger may be employed to cool the immediate area or to use a fluid transfer medium to circulate a cooled fluid to some remote location for effecting a cooling of that area.

PREFERRED EMBODIMENT

Figure 1:
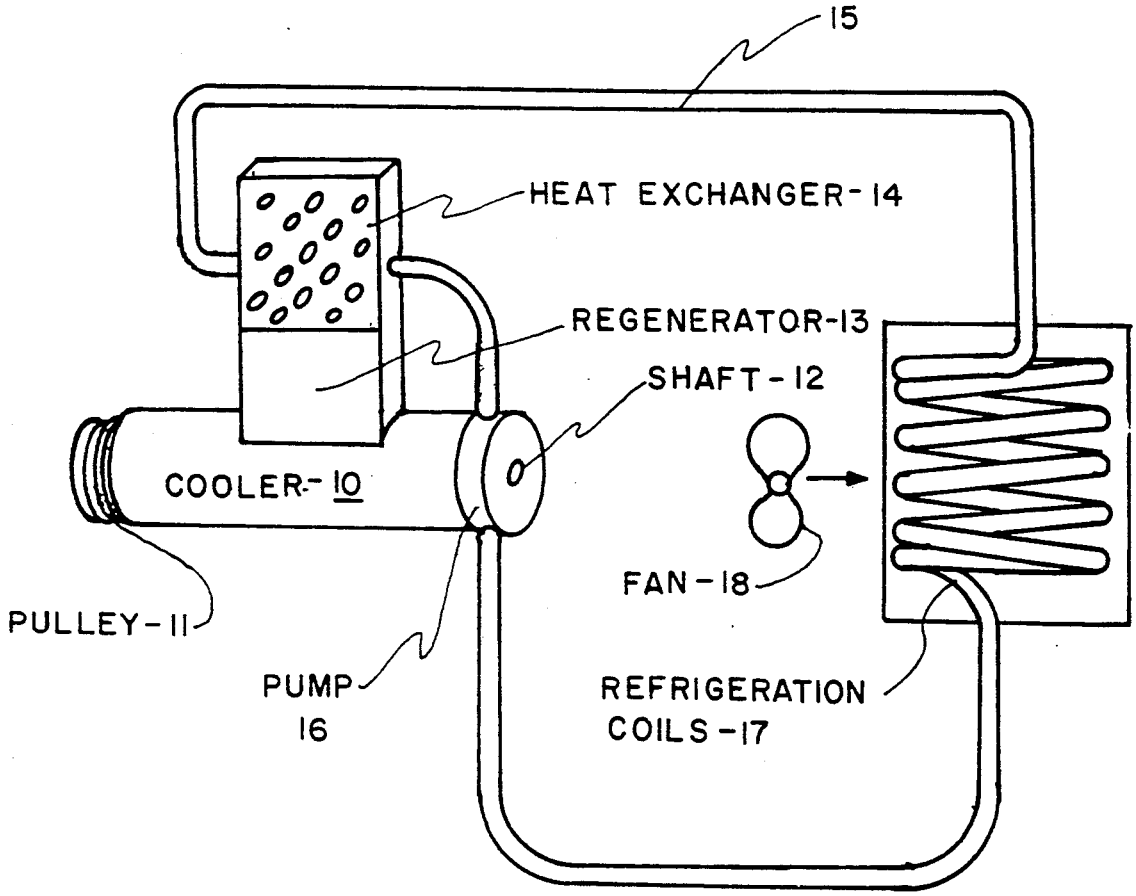
FIG. 1 shows a specific embodiment of a Stirling cycle cooler as embodied in an automotive air conditioner system.

Perhaps this invention can best be understood by referring specifically to FIG. 1, which embodies one application of this concept in an automotive air conditioner. The Stirling cycle cooler 10 may be driven in the same manner that the compressor of a typical automotive air conditioner is driven. A pulley 11, coupled to a central shaft 12, may be engaged with one of the fan belts (not shown), which is normally used for driving accessory equipment on an internal combustion engine. The shaft 12 drives a regenerator 13 which provides cooling for the heat exchanger 14. A number of different gases can be and have been used in the regenerator 13, but none are to be used having a freon or hydrofluocarbon base, even though it would function just as well with these gases as with the environmentally safe gases so selected. Helium may be used when very low temperatures are desired, but very close tolerances are required for seals and mating surfaces to assure integrity of the sealed system. Nitrogen may also be used, and is, indeed, preferred, compared to helium, as nitrogen is more dense and accordingly, does not require the tight and close tolerances as does helium.

In the present instance, it is desired to cool an area remote from the cooler 10, which requires both a means and a medium for achieving such. We show in FIG. 1, a closed loop system, generally referred to as 15, coupled to the heat exchanger 14, which serves as the means for directing a cooling medium to the remote location, in this instance the cabin of an automobile.

The medium consists of a coolant fluid circulating through the closed loop system, which may be, for instance, a water/antifreeze solution, with equal proportions being typical. The medium is pumped through the closed system 15 a pump 16, through refrigeration coils 17, across which air is forced by a fan 18, thus effecting a cooling of the interior of the automobile, with a return of the coolant to the heat exchanger 14 whereby the heat is removed from the coolant and the cycle is repeated. The fluid flow is approximately 3 gal/min with a cooling capacity of about 12,000 BTUs/hr.

Figure 2:
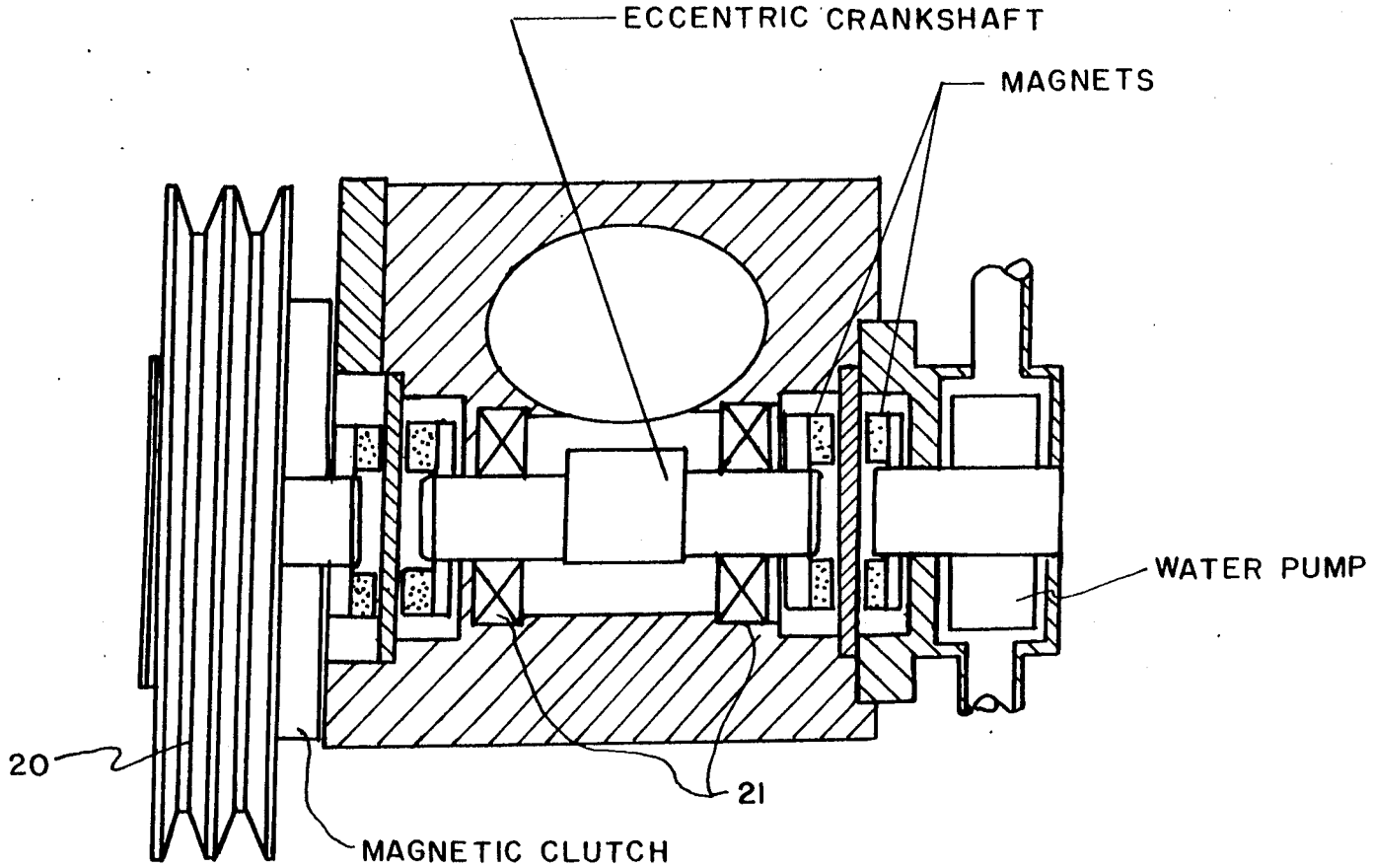
FIG. 2 shows an embodiment of the Stirling cycle compressor with the magnetic couplings between the power source and water pump.

As shown in FIG. 2, the automotive application is one in which shaft power is available via the internal combustion engine. This power is transmitted via a belt to a pulley 20. The pulley has a magnetic clutch as an integral part of its embodiment. This source of power which can be activated or deactivated via a control is the source of power for the air conditioner.

The auto air conditioner using the Stirling cycle as the cooling mechanism is coupled to the magnetic clutch and pulley via a magnetic coupling inherent in the new design. The magnetic coupling shown as two magnetically coupled plates enables the cooler to be hermetically sealed with no dynamic seal separating ambient from the refrigerant gas. The magnetic coupling device couples shaft power from the magnetic clutch to the shaft inside the A/C housing. Coupling is performed through the wall of the air conditioner housing. Leakage of refrigerant via shaft power coupling is thereby eliminated.

Another unique technique is the delivery of refrigeration to the car interior. The cooling occurs at the cold finger of the Stirling cooler. As shown in FIG. 1, the cooling effect must be transported from the cold finger to a cooling coil under the dashboard. A fan blowing air across this coil thereby delivers cold air to the car interior. The mechanism for this delivery is as follows:

a small heat exchanger 14 is attached to the cold finger consisting of a copper or other high thermal conductivity block. This block contains holes (with exchange area) for antifreeze to travel across and thus prechill the antifreeze. A small impeller pump is magnetically coupled to the other end of the cooler crankshaft in the same manner as the shaft power is coupled to the cooler crankshaft, the cooler shaft turns and the pump rotates, circulating the antifreeze across the cold finger heat exchanger and through fluid lines that form a closed path with the heat exchange coil under the dash board. The flow rate of the water is designed to deliver enough chilled antifreeze/water to equal the cooling requirements of the automobile passengers via the temperature setting control inside the car.

A low cost displacer regenerator is used in this design to reduce costs. The regenerator is made out of low thermal conductivity material with holes drilled in it to yield the proper heat transfer area and flow resistance. The annular space between the displacer and cold finger wall is treated as another regenertive heat exchange path and hence does not require a seal. The displacer, therefore, serves two functions, one is to create a phased expansion cold space for the refrigerant, and the second is to provide a low flow resistance path and heat exchange. This sealess design replaces the conventional design whereby a cold displacer seal is required.

The compressor piston is designed for a clearance seal or ring seal.

The crankshaft is designed with a small bearing sleeve 21 to eliminate grinding operations to reduce production cost.

The drive may be either a scotch yoke design or a cam follower design. This method reduces the package size and side forces that would normally exist in the standard piston and displacer design. Eliminating the side force reduces the requirement for a large connecting rod to shaft eccentric ratio.

A purge valve (not shown) will be part of the embodiment. This will allow easy recharge and purge.

The outer cooling housing and cold finger will be made of one material reducing costs and potential leaks. This idea lends itself to high volume production. Stirling cryogenic coolers require a cold finger of different material than the housing. Nitrogen, Neon, Argon or any other inert and environmentally safe gas may be used. Nitrogen seems to be one of the better choices at present, is much denser than helium (which is used in cryogenic coolers) and will result in diminished refrigerant leakage and looser compressor seal tolerances.

We claim:

1. In a closed loop cooling system using a circulating coolant fluid as a heat transfer medium and including a first heat exchanger means for cooling a selected area, means for circulating the coolant to said heat exchanger and a Stirling cycle cooler having a second heat exchanger means for removing heat from the recirculating heat laden coolant, wherein the improvement comprises a hermetically sealed Stirling cycle cooler employing an environmentally safe non-freon base coolant and having a magnetic clutch for coupling a pulley driven power thereto, a first magnetic coupling means for magnetically coupling shaft power of the driven pulley to a first end of a crankshaft of the Stirling cycle cooler through a first end-wall of the hermetically sealed cooler and a second magnetic coupling means for magnetically coupling a second end of the cooler crankshaft through a second end-wall of the hermetically sealed cooler to an impeller pump for pumping the coolant through the closed loop system, whereby the Stirling cycle cooler and the closed loop cooling system constitute two separate hermetically sealed systems for effectively eliminating refrigerant coolant leakage through housing shaft seals.

2. The closed loop cooling system as recited in claim 1, wherein the non-freon base coolant used in the Stirling cycle cooler is selected from the group of gases consisting of Helium, Nitrogen, Neon and Argon.

3. The closed loop cooling system as recited in claim 1, wherein the magnetic coupling means used to couple the shaft power through the housing of the hermetically sealed Stirling cycle cooler to the crankshaft of the cooler and to magnetically couple the crankshaft on the other end, through the housing of the cooler to the pump, comprises magnetic plates properly aligned and on opposit sides of the housing of the cooler to effect a non-invasive end-coupling between the respective shafts.

* * * * *